US009618183B2

(12) United States Patent
Krames et al.

(10) Patent No.: US 9,618,183 B2
(45) Date of Patent: Apr. 11, 2017

(54) APPORTIONING OPTICAL PROJECTION PATHS IN AN LED LAMP

(71) Applicant: SORAA, INC., Fremont, CA (US)

(72) Inventors: Michael R. Krames, Mountain View, CA (US); Frank Shum, Sunnyvale, CA (US)

(73) Assignee: Soraa, Inc., Fremont, CA (US)

( * ) Notice: Subject to any disclaimer, the term of this patent is extended or adjusted under 35 U.S.C. 154(b) by 0 days.

(21) Appl. No.: 15/051,119

(22) Filed: Feb. 23, 2016

(65) Prior Publication Data

US 2016/0169476 A1 Jun. 16, 2016

Related U.S. Application Data

(63) Continuation of application No. 14/191,679, filed on Feb. 27, 2014, now Pat. No. 9,267,661.

(60) Provisional application No. 61/851,094, filed on Mar. 1, 2013.

(51) Int. Cl.

| | |
|---|---|
| ***F21V 7/00*** | (2006.01) |
| ***F21V 13/08*** | (2006.01) |
| ***F21V 5/04*** | (2006.01) |
| ***F21V 9/08*** | (2006.01) |
| ***F21K 9/23*** | (2016.01) |
| ***F21K 9/60*** | (2016.01) |
| *F21V 29/74* | (2015.01) |
| *F21Y 101/00* | (2016.01) |

(52) U.S. Cl.

CPC ..... *F21V 7/0016* (2013.01); *F21K 9/23* (2016.08); *F21K 9/60* (2016.08); *F21V 5/04* (2013.01); *F21V 9/08* (2013.01); *F21V 13/08* (2013.01); *F21V 29/74* (2015.01); *F21Y 2101/00* (2013.01)

(58) Field of Classification Search

None

See application file for complete search history.

(56) References Cited

U.S. PATENT DOCUMENTS

2006/0105485 A1* 5/2006 Basin ..... H01L 24/97 438/27

2007/0047232 A1* 3/2007 Kim ..... F21V 5/04 362/305

* cited by examiner

*Primary Examiner* — Britt D Hanley

(74) *Attorney, Agent, or Firm* — Saul Ewing LLP

(57) ABSTRACT

A light-emitting system for emitting light, comprising: (a) at least one light-emitting diode (LED) configured to emit LED light; (b) at least one optical element optically coupled to said at least one LED and configured to direct a first fraction of said LED light along a first optical path and a second fraction of said LED light along a second optical path; and (c) a color modification element disposed along said second optical path and configured to modify the spectrum of said second fraction of said LED light to emit modified light.

10 Claims, 18 Drawing Sheets

1A00

1B00

1A00

1B00

1C00

4A00

4B00

4C00

APPORTIONING OPTICAL PROJECTION PATHS IN AN LED LAMP

CROSS-REFERENCE TO RELATED APPLICATIONS

This application is a continuation of U.S. application Ser. No. 14/191,679, filed Feb. 27, 2014, which claims benefit of U.S. Provisional Application No. 61/851,094, filed Mar. 1, 2013, both of which are herein incorporated by reference in their entireties.

FIELD

The disclosure relates to the field of LED illumination systems and more particularly to techniques for apportioning optical projection paths in an LED lamp.

BACKGROUND

Conventional halogen-based MR16 lamps include certain designs. In many cases, for aesthetic purposes, perceptible radiation is emitted in a direction substantially opposite that of the projection direction. For example, MR16 lamps on "track lighting" systems used in higher-end restaurants employ this characteristic. This backward-emitted light is actually the residual effect of visible light leakage through the dichroic filter applied to the reflector in many MR16 lamps. The multi-layered reflector causes different regimes of the visible spectrum to be transmitted (backwards) or reflected (projected), so that the backward emitted light has a "rainbow" appearance which is pleasing to the eye and contributes positively to the overall ambience. A side-view photograph of such a halogen lamp in operation is shown below (left).

Unfortunately, halogen lamps are extremely inefficient (~10-20 lm/W, or ~5% of theoretical light-generation efficiency) and are thus not cost effective to operate. LED reflector lamps, on the other hand, exhibit efficacies up to 60 lm/W (~20% efficient) and correspondingly lower operating costs. However, LED reflector lamp designs today substantially block the backward emitted light, and thus are unable to provide an aesthetic feature that is highly valued by many lighting designers and end users (see above: middle, right). Thus, legacy LED reflector lamps are not able to be deployed in certain applications, meaning reduced market adoption for energy-efficient lamps and thus slower reduction of greenhouse gas emissions associated with electricity consumption for lighting.

Prior descriptions of LED lamps to effect decorative illumination require additional LEDs to provide such illumination directly (e.g., U.S. Pat. No. 7,597,456). The additional LEDs add cost and complexity to the LED lamp. What is needed is a cost-effective LED reflector lamp solution that provides for backward emitted light. The aforementioned legacy technologies do not have the capabilities to perform apportioning of the optical projection paths in an LED lamp. Therefore, there is a need for improved approaches.

BRIEF DESCRIPTION OF THE DRAWINGS

Those skilled in the art will understand that the drawings, described herein, are for illustration purposes only. The drawings are not intended to limit the scope of the present disclosure.

DETAILED DESCRIPTION

Definitions

Figure 1A:
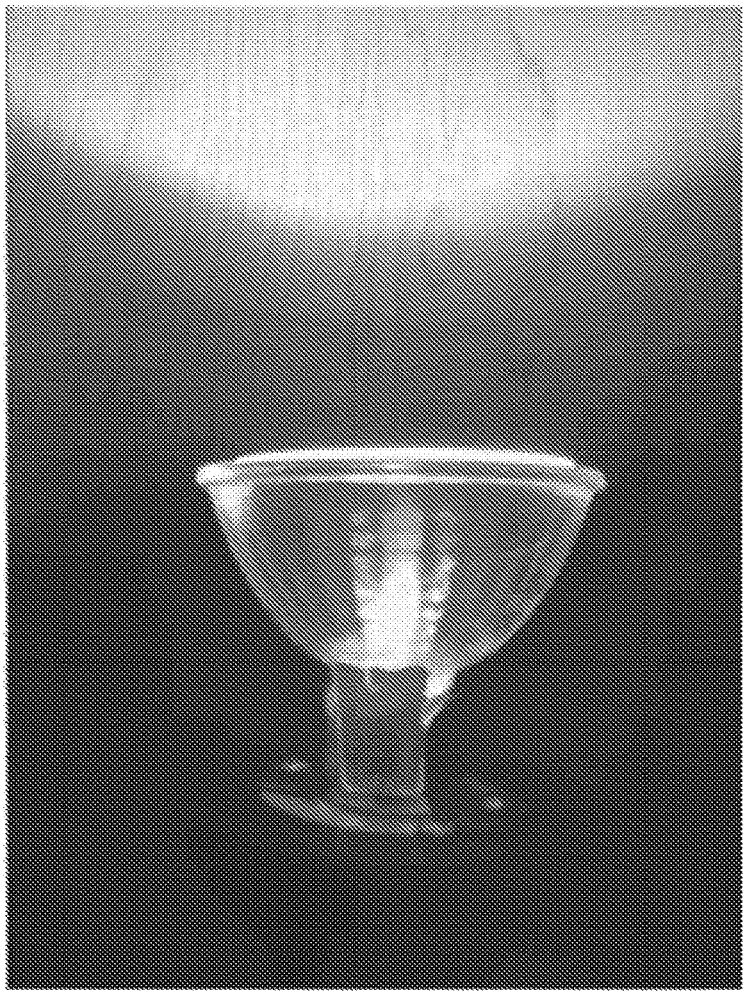
FIG. 1A exemplifies a halogen lamp with a dichroic reflector.

The term "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The term "or" is intended to mean an inclusive "or" rather than an exclusive "or". That is, unless specified otherwise, or is clear from the context, "X employs A or B" is intended to mean any of the natural inclusive permutations. That is, if X employs A, X employs B, or X employs both A and B, then "X employs A or B" is satisfied under any of the foregoing instances. In addition, the articles "a" and "an" as used in this application and the appended claims should generally be construed to mean "one or more" unless specified otherwise or is clear from the context to be directed to a singular form.

A "module" includes any mix of any portions of computer memory and any extent of circuitry including circuitry embodied as a processor.

Reference is now made in detail to certain embodiments. The disclosed embodiments are not intended to be limiting of the claims.

Overview

An LED-based emitter is mounted on a heatsink and electrically connected to a socket connector (GU10, E27, EZ10, etc.). The emitter is optically coupled to one or more lens elements which has the primary function to project light from the emitter into the desired beam for the reflector lamp type being emulated (e.g., MR16 spot, narrow-flood, wide-flood, etc.). The emitter ("LED") faces towards the projection direction; geometry is shown below (left). A typical lens element might be a total-internal-reflector (TIR) lens. The lens is designed to allow a perceptible amount of light to "leak" backwards as described above. More importantly, the lamp housing is designed such that there is a direct optical path for the leaked light from the lens to outside of the lamp envelope.

In one embodiment, the emitter is direct-bonded to a heatsink comprising a branch configuration for convective thermal management, as described by Shum et al. in U.S. patent application Ser. No. 13/025,791. A side-view photograph of such a lamp in operation is shown in FIG. 2B. The backward-emitting leaked light is clearly visible.

In another embodiment, the side surface(s) of a TIR lens may be coated with a multi-layer ("dichroic") reflector in order to provide a "rainbow" appearance to the backward-emitted light. Different appearances can be achieved by changing the reflector coating and may be tuned to suit certain applications and/or customers. The same effect could be achieved with a reflective lens, wherein the opaque metallized reflective layers are replaced by a combination of dichroic coating and thin metal reflective layers.

In another embodiment, a color modification element is provided between the lens and the back-side of the LED lamp housing. The color modification element may compromise a dichroic filter, an absorbing medium, a pigmented medium, or a fluorescing medium.

In one embodiment, the color modification element is a lens retaining sheath. A prototype of this embodiment is shown in the figures below. The retaining sheath is comprised of colored plastic which serves to determine the color of the decorative light emitted out the backside of the lamp. In principle, the retaining sheath could be "field-changeable" so that scenes employing such lamps could be configured for different colors of decorative lighting on an ongoing basis. In cases wherein decorative lighting is not wanted, the sheath could be provided as opaque.

While the present description is focused on MR16 lamp form factors, other reflective lamp form factors (e.g., PAR, AR-111, etc.) are within the scope of the invention as well as new reflective lamp form factors which will develop in the future. Thus the invention is not limited to specific types of reflective lamp form factors.

Descriptions of Exemplary Embodiments

FIG. 1A exemplifies a halogen lamp with a dichroic reflector 1A00 apportioning optical projection paths in an LED lamp. As an option, the present dichroic reflector 1A00 may be implemented in the context of the architecture and functionality of the embodiments described herein. The dichroic reflector 1A00 or any aspect therein may be implemented in any desired environment.

Figure 1B:
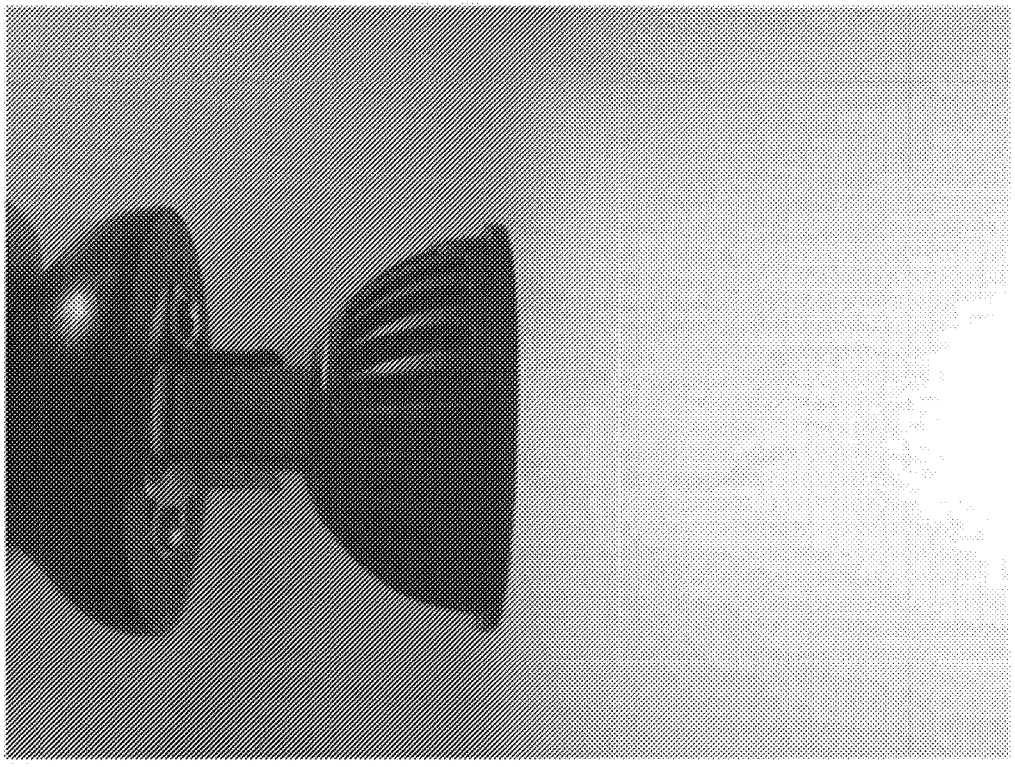
FIG. 1B exemplifies a low or zero reverse apportioned LED lamp that exemplifies low bound or zero bound of apportioning optical projection paths in an LED lamp, according to some embodiments.

FIG. 1B exemplifies a low or zero reverse apportioned LED lamp 1B00 that exemplifies lower bounds of apportioning optical projection paths in an LED lamp. As an option, the present low or zero reverse apportioned LED lamp 1B00 may be implemented in the context of the architecture and functionality of the embodiments described herein. The low or zero reverse apportioned LED lamp 1B00 or any aspect therein may be implemented in any desired environment.

The apportioning causes different regimes of the visible spectrum to be transmitted (backwards) or reflected (projected), so that the backward emitted light has a controllable and/or selectable appearance.

Figure 1C:
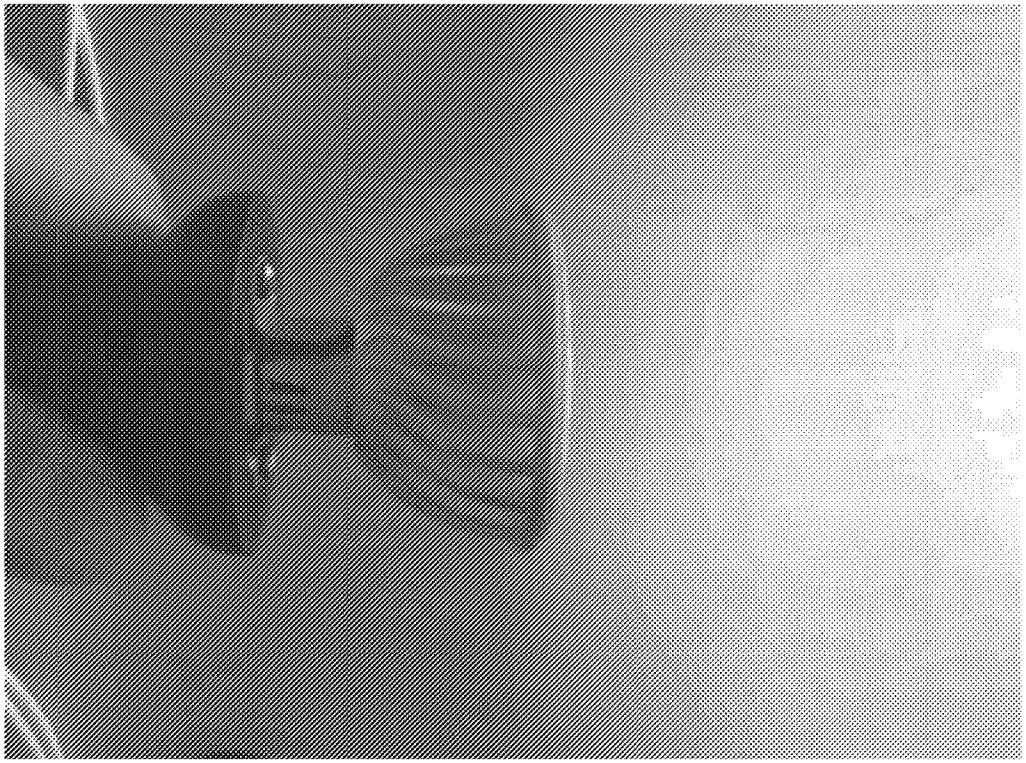
FIG. 1C exemplifies an alternative low or zero reverse apportioned LED lamp that exemplifies lower bounds of apportioning optical projection paths in an LED lamp, according to some embodiments.

FIG. 1C exemplifies an alternative low or zero reverse apportioned LED lamp 1C00 that exemplifies lower bounds of apportioning optical projection paths in an LED lamp. As an option, the present low or zero reverse apportioned LED lamp 1C00 may be implemented in the context of the architecture and functionality of the embodiments described herein. The low or zero reverse apportioned LED lamp 1C00 or any aspect therein may be implemented in any desired environment.

Figure 2A:
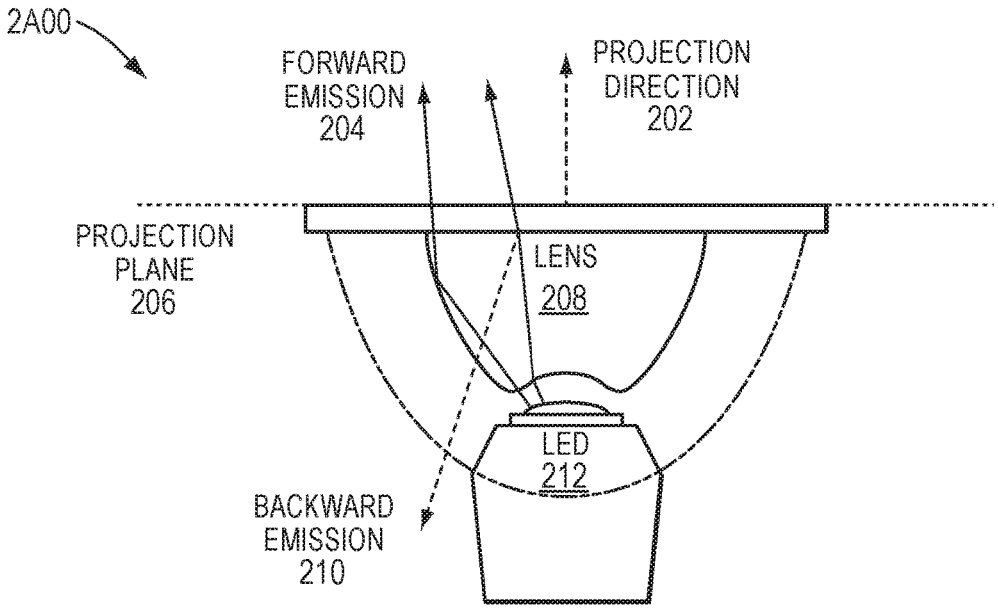
FIG. 2A is a schematic that shows techniques for apportioning optical projection paths in an LED lamp, according to some embodiments.
Figure 2B:
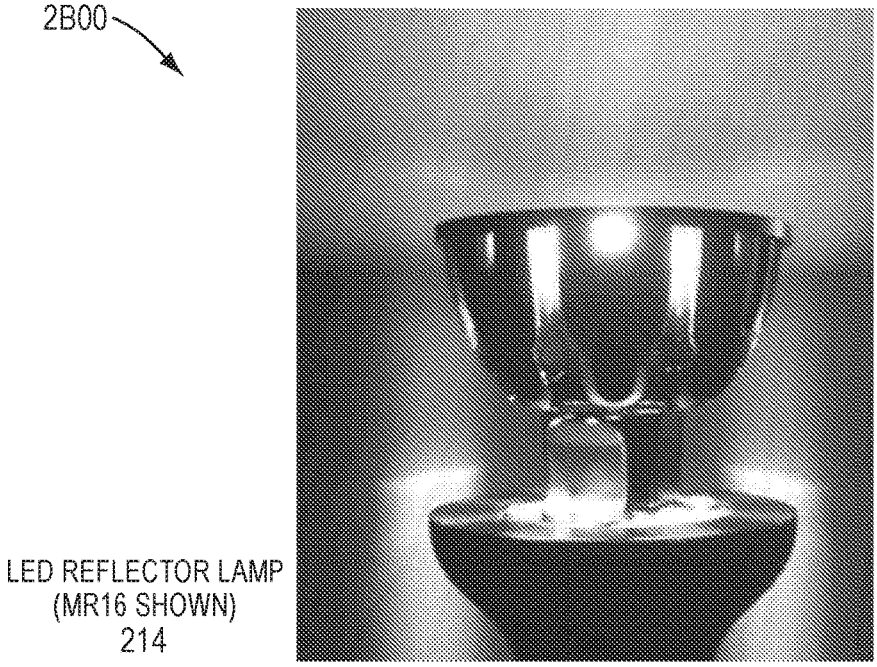
FIG. 2B is a side view of an MR16 reflector lamp having a dichroic TIR lens that exhibits apportioning optical projection paths in an LED lamp, according to some embodiments.

FIG. 2A is a schematic 2A00 that shows techniques for apportioning optical projection paths in an LED lamp. As an option, the present schematic 2A00 may be implemented in the context of the architecture and functionality of the embodiments described herein. The schematic 2A00 or any aspect therein may be implemented in any desired environment.

As shown, an LED 212 emits light, which light is incident on lens 208. Some of the light passes through a projection plane 206, resulting in forward emission 204. Some of the light reflects off of a projection plane 206, resulting in rearward or backward emission 210

FIG. 2B is a side view of an MR16 reflector lamp 2B00 having a dichroic TIR lens that exhibits apportioning optical projection paths in an LED lamp. As an option, the present MR16 reflector lamp 2B00 may be implemented in the context of the architecture and functionality of the embodiments described herein. The MR16 reflector lamp 2B00 or any aspect therein may be implemented in any desired environment.

The MR16 reflector lamp 2B00 (or other lamps) may be inserted partially or completely into an electrical fixture or housing. The shown electrical fixture provides a mechanical and electrical mount point for connecting the lamp to a power source. The shown electrical fixture can further be fitted with electrical mount points (e.g., connectors inside or outside a housing) and/or the electrical fixture can further be fitted with additional mechanical mount points (e.g., such as in a luminaire) for retaining the lamp in a position.

Figure 3A:
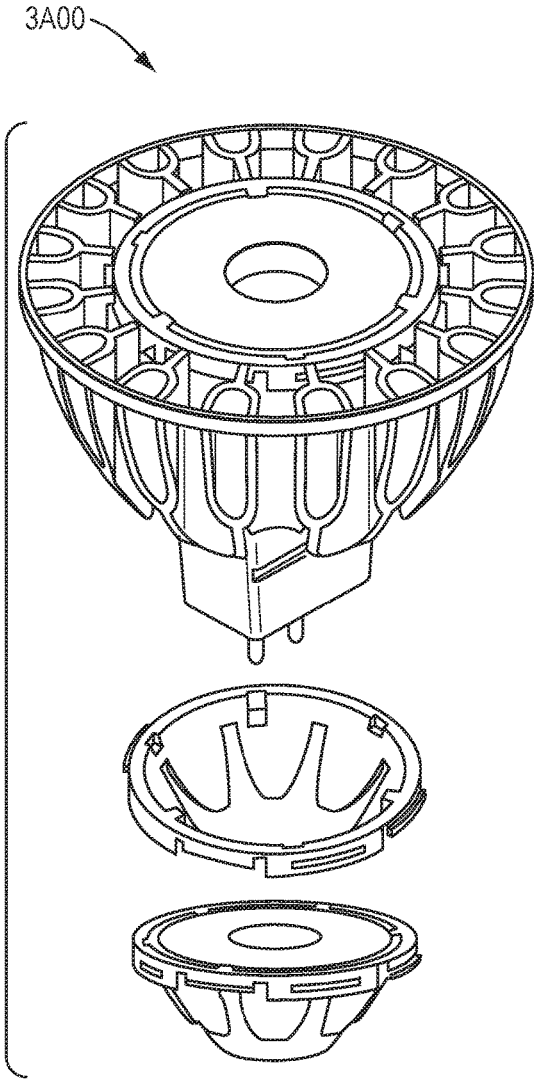
FIG. 3A shows a series of assembly views of a lamp having a color modification element that exhibits apportioning optical projection paths in an LED lamp, according to some embodiments.

FIG. 3A shows a series of assembly views of a lamp 3A00 having a color modification element that exhibits apportioning optical projection paths in an LED lamp. As an option, the present lamp 3A00 may be implemented in the context of the architecture and functionality of the embodiments described herein. The lamp 3A00 or any aspect therein may be implemented in any desired environment.

The shown color modification element can be fitted to a lens or ring or heatsink.

Figure 3B:
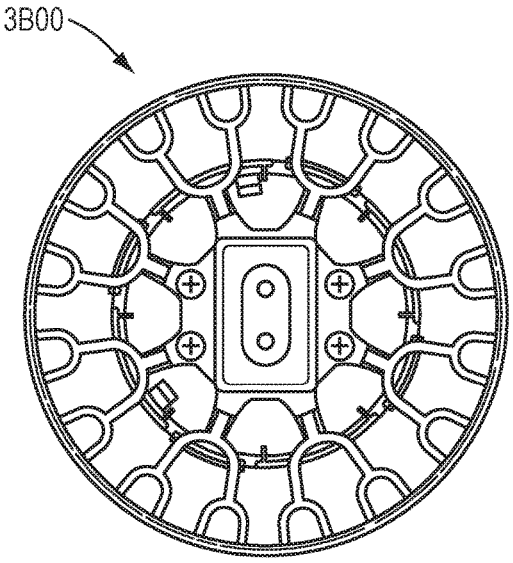
FIG. 3B shows a bottom view of a lamp fitted with a color modification element that exhibits apportioning optical projection paths in an LED lamp, according to some embodiments.

FIG. 3B shows a bottom view of a lamp 3B00 fitted with a color modification element that exhibits apportioning optical projection paths in an LED lamp. As an option, the present lamp 3B00 may be implemented in the context of the architecture and functionality of the embodiments described herein. The lamp 3B00 or any aspect therein may be implemented in any desired environment.

Figure 4A:
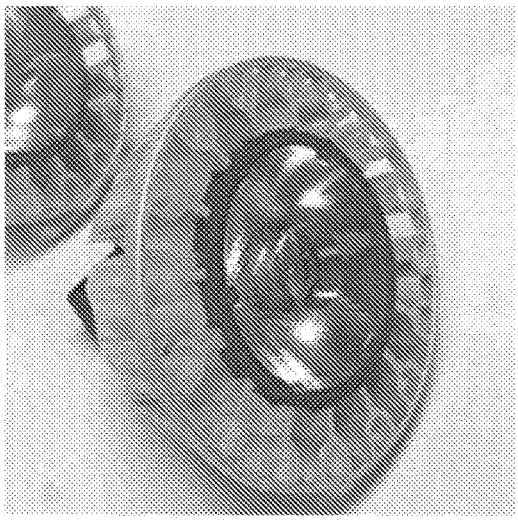
FIG. 4A shows a side view of a lamp fitted with a color modification element in the form of a color-bearing retaining sheath that exhibits apportioning optical projection paths in an LED lamp, according to some embodiments.

FIG. 4A shows a side view of a lamp 4A00 fitted with a color modification element in the form of a color-bearing retaining sheath that exhibits apportioning optical projection paths in an LED lamp. As an option, the present lamp 4A00 may be implemented in the context of the architecture and functionality of the embodiments described herein. The lamp 4A00 or any aspect therein may be implemented in any desired environment.

Figure 4B:
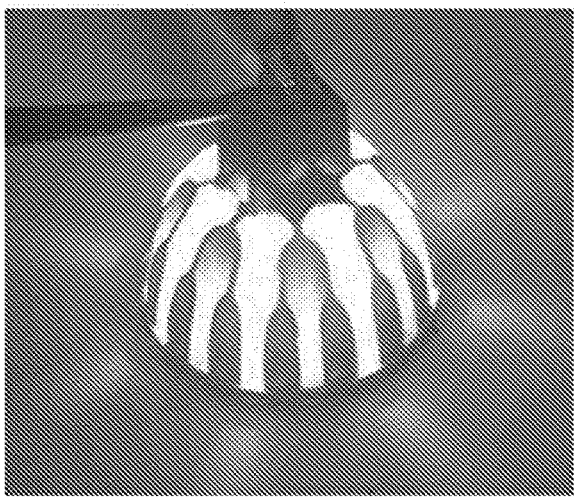
FIG. 4B shows a rear view of a lamp fitted with a color modification element in the form of a color-bearing retaining sheath that exhibits substantial rearward projection in a system for apportioning optical projection paths in an LED lamp, according to some embodiments.

FIG. 4B shows a rear view of a lamp 4B00 fitted with a color modification element in the form of a color-bearing retaining sheath that exhibits substantial rearward projection in a system for apportioning optical projection paths in an LED lamp. As an option, the present lamp 4B00 may be implemented in the context of the architecture and functionality of the embodiments described herein. The lamp 4B00 or any aspect therein may be implemented in any desired environment.

Figure 4C:
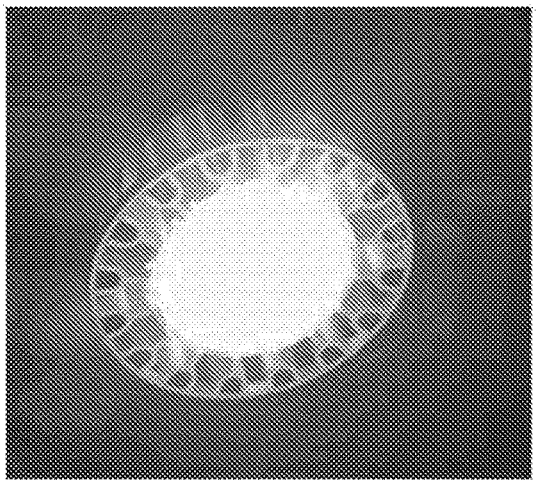
FIG. 4C shows a front view of a lamp fitted with a color modification element in the form of a color-bearing retaining sheath that exhibits substantial rearward projection in a system for apportioning optical projection paths in an LED lamp, according to some embodiments.

FIG. 4C shows a front view of a lamp 4C00 fitted with a color modification element in the form of a color-bearing retaining sheath that exhibits substantial rearward projection in a system for apportioning optical projection paths in an LED lamp. As an option, the present lamp 4C00 may be implemented in the context of the architecture and functionality of the embodiments described herein. The lamp 4C00 or any aspect therein may be implemented in any desired environment.

Figure 5A:
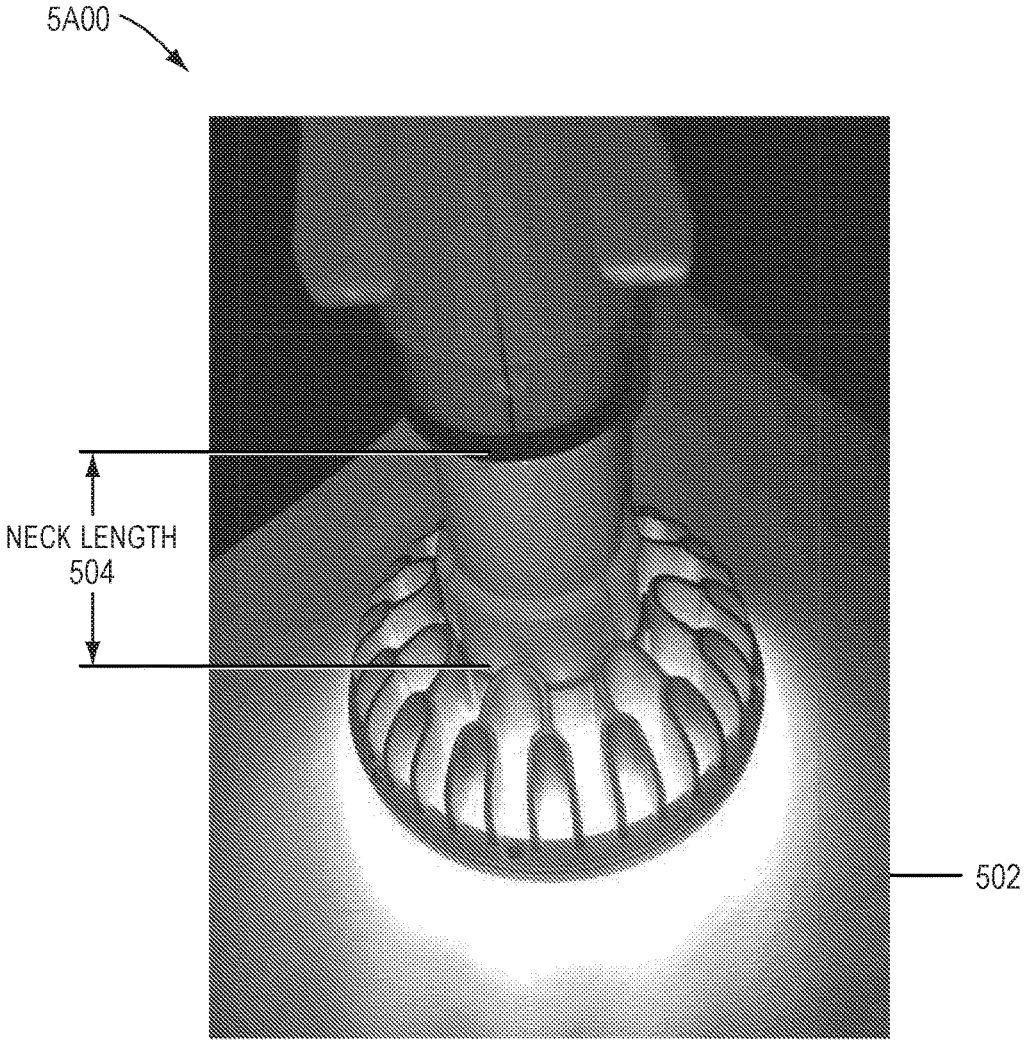
FIG. 5A is a side view of a PAR30L lamp, showing visible effects of apportioning optical projection paths, according to some embodiments.

FIG. 5A is a side view of a PAR30L lamp showing visible effects of apportioning optical projection paths, according to some embodiments. This embodiment is in the form of a lamp 500 comprising one or more light-emitting diodes and a lens within an envelope (e.g., form factor of the PAR30L lamp). As shown, the lamp has a projection plane at a primary exit surface of the lens (e.g., in this case the shown downward-direction, away from the neck). In this embodiment:

At least some of the light-emitting diodes face toward the primary projection plane to form a primary projection path.

Additionally, the envelope of the shown form factor and characteristics of the heatsink 502 provides a direct optical path other than the primary projection path for perceptible light from the light-emitting diodes to emanate to points outside the envelope, wherein the emanated light from the direct optical path other than the primary projection path does not intersect the projection plane.

It is possible that emanated light from the direct optical path other than the primary projection path can reflect off of surroundings, and those reflections can possibly intersect the projection plane, however such reflections comprise indirect paths rather than direct optical paths.

The PAR30L lamp has a primary projection direction that is normal to the projection plane (e.g., pointing away from both the lens and the light-emitting diodes, as show) wherein the perceptible light is emitted at angles greater than 90 degrees from the projection direction. Other designs emanate perceptible light at angles greater than 120 degrees from the projection direction.

Figure 5B:
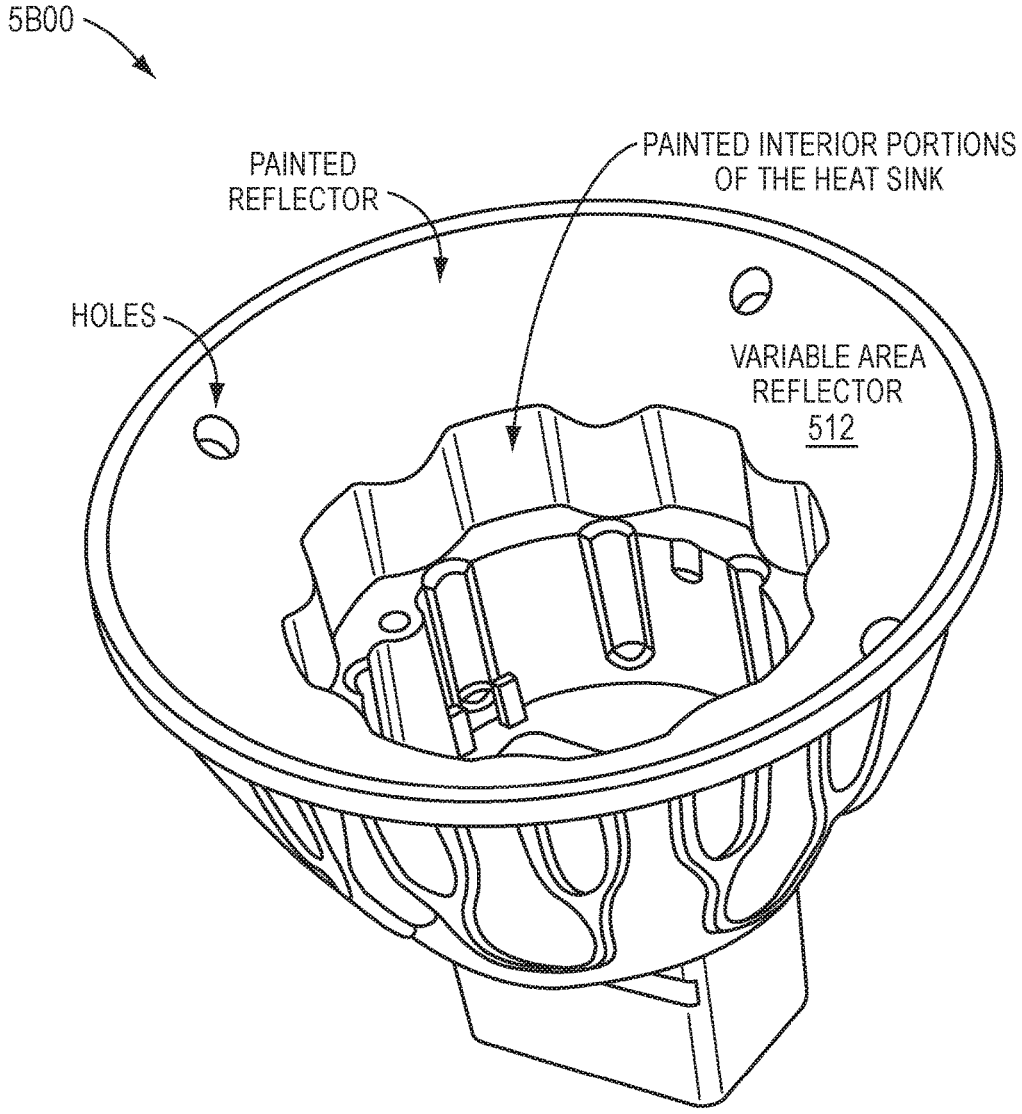
FIG. 5B is a top orthogonal view of a PAR30L lamp, showing a variable surface area reflector for use in apportioning optical projection paths, according to some embodiments.

FIG. 5B is a top orthogonal view of a MR-16 lamp, showing a variable surface area reflector for use in apportioning optical projection paths, according to some embodiments.

As shown, the construction of the lamp includes a reflective surface in the form of a reflector that is integrated with or added to the heatsink body. The shown variable area reflector 526 can be formed by shaping and/or treating surfaces of the heatsink, or can be an element that is fitted in place over or near the surfaces of the heatsink. In some embodiments, the variable area reflector 526 is painted or otherwise treated to exhibit particular reflective characteristics.

As can be seen, the aforementioned reflector serves to apportion the light from the LED(s), depending at least in part on the size and shape of the reflector. Specifically, the location of the light-emitting diodes and the shape and reflective characteristics of the reflector (with or without paint or treatment), and/or the presence of absence and size and shape of holes or other openings provided in the reflector, and/or the shape an reflective characteristics of the interior and lateral surfaces of the heatsink 502 serve to provide a primary projection path through the projection plane for light from the light-emitting diodes as well as at least some paths of reflected light through the projection plane. Further, the shape of the reflector and/or the presence of absence and size and shape of holes or other openings provided in the reflector allows for some perceptible light from the light-emitting diodes to emanate to points outside the envelope, wherein the perceptible light from the direct optical path other than the primary projection path does not intersect the projection plane (e.g., the reflector allows for some perceptible light from the light-emitting diodes to emanate through the back side of the heatsink).

The lamps depicted in FIGS. 5A and 5B (e.g., lamp 500) each have an envelope similar to a PAR30L lamp, and MR-16 lamp respectively, however other embodiments may have different envelopes. For example, the neck length 504 (see FIG. 5A) can be shortened (e.g., to comport with a PAR30S form factor), or for example, the shape of an envelope can corresponds to an A series lamp, a PS series lamp, a B series lamp, a C series lamp, a CA series lamp, an RP series lamp, an S series lamp, an F series lamp, an R series lamp, an MR series lamp, a BR series lamp, a G series lamp, a T series lamp, a BT series lamp, an E series lamp, an ED series lamp, an AR series lamp, and a PAR series lamp, and others (see FIG. 6).

The aforementioned lamps are merely selected embodiments of lamps that conform to fit with any one or more of a set of mechanical and electrical standards. Other form factors comporting to various mechanical and electrical standards are possible, and a selection of such mechanical and electrical standards are briefly discussed below.

Figure 6:
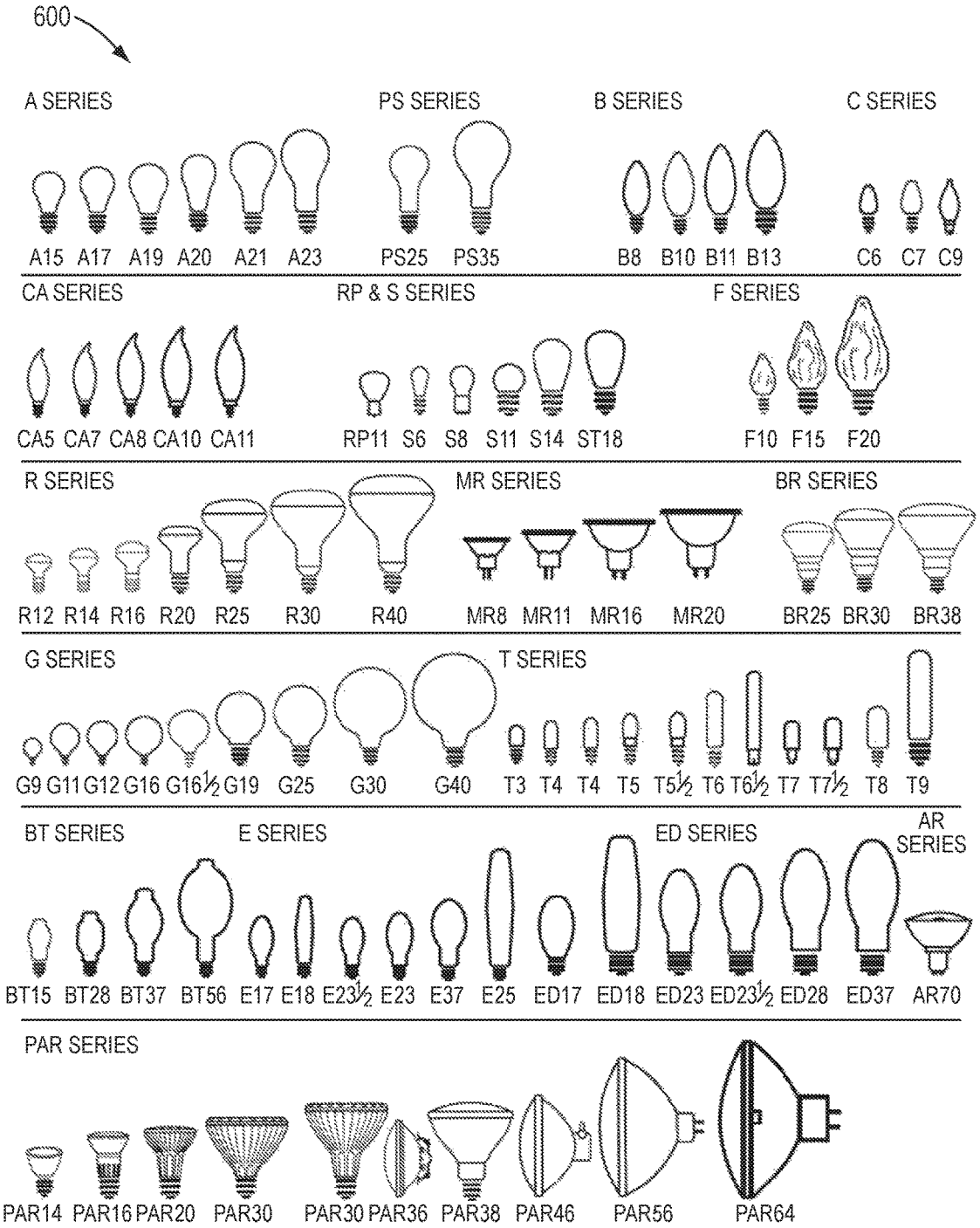
FIG. 6 depicts side views of a selection of form factors, according to some embodiments.

FIG. 6 depicts side views of a selection of form factors. Embodiments of the present disclosure can be implemented in any of the shown lamps. Moreover, and as shown, a particular form factor may be configured to confirm to one or more standards corresponding to bases and/or electrical connections. For example, Table 1 gives standards (see "Designation") and corresponding characteristics.

TABLE 1

| Designation | Base Diameter (Crest of thread) | Name | IEC 60061-1 standard sheet |
|---|---|---|---|
| E05 | 05 mm | Lilliput Edison Screw (LES) | 7004-25 |
| E10 | 10 mm | Miniature Edison Screw (MES) | 7004-22 |
| E11 | 11 mm | Mini-Candelabra Edison Screw (mini-can) | (7004-06-1) |

TABLE 1-continued

| Designation | Base Diameter (Crest of thread) | Name | IEC 60061-1 standard sheet |
|---|---|---|---|
| E12 | 12 mm | Candelabra Edison Screw (CES) | 7004-28 |
| E14 | 14 mm | Small Edison Screw (SES) | 7004-23 |
| E17 | 17 mm | Intermediate Edison Screw (IES) | 7004-26 |
| E26 | 26 mm | [Medium] (one-inch) Edison Screw (ES or MES) | 7004-21A-2 |
| E27 | 27 mm | [Medium] Edison Screw (ES) | 7004-21 |
| E29 | 29 mm | [Admedium] Edison Screw (ES) | |
| E39 | 39 mm | Single-contact (Mogul) Giant Edison Screw (GES) | 7004-24-A1 |
| E40 | 40 mm | (Mogul) Giant Edison Screw (GES) | 7004-24 |

Additionally, the base member of a lamp can be of any form factor configured to support electrical connections, which electrical connections can conform to any of a set of types or standards. For example Table 2 gives standards (see "Type") and corresponding characteristics, including mechanical spacing between a first pin (e.g., a power pin) and a second pin (e.g., a ground pin).

TABLE 2

| Type | Standard | Pin centre to centre | Pin Diameter | Usage |
|---|---|---|---|---|
| G4 | IEC 60061-1 (7004-72) | 4.0 mm | 0.65-0.75 mm | MR11 and other small halogens of 5/10/20 watt and 6/12 volt |
| GU4 | IEC 60061-1 (7004-108) | 4.0 mm | 0.95-1.05 mm | |
| GY4 | IEC 60061-1 (7004-72A) | 4.0 mm | 0.65-0.75 mm | |
| GZ4 | IEC 60061-1 (7004-64) | 4.0 mm | 0.95-1.05 mm | |
| G5 | IEC 60061-1 (7004-52-5) | 5 mm | | T4 and T5 fluorescent tubes |
| G5.3 | IEC 60061-1 (7004-73) | 5.33 mm | 1.47-1.65 mm | |
| G5.3-4.8 | IEC 60061-1 (7004-126-1) | | | |
| GU5.3 | IEC 60061-1 (7004-109) | 5.33 mm | 1.45-1.6 mm | |
| GX5.3 | IEC 60061-1 (7004-73A) | 5.33 mm | 1.45-1.6 mm | MR16 and other small halogens of 20/35/50 watt and 12/24 volt |
| GY5.3 | IEC 60061-1 (7004-73B) | 5.33 mm | | |
| G6.35 | IEC 60061-1 (7004-59) | 6.35 mm | 0.95-1.05 mm | |
| GX6.35 | IEC 60061-1 (7004-59) | 6.35 mm | 0.95-1.05 mm | |
| GY6.35 | IEC 60061-1 (7004-59) | 6.35 mm | 1.2-1.3 mm | Halogen 100 W 120 V |
| GZ6.35 | IEC 60061-1 (7004-59A) | 6.35 mm | 0.95-1.05 mm | |
| G8 | | 8.0 mm | | Halogen 100 W 120 V |
| GY8.6 | | 8.6 mm | | Halogen 100 W 120 V |
| G9 | IEC 60061-1 (7004-129) | 9.0 mm | | Halogen 120 V (US)/230 V (EU) |
| G9.5 | | 9.5 mm | 3.10-3.25 mm | Common for theatre use, several variants |

TABLE 2-continued

| Type | Standard | Pin centre to centre | Pin Diameter | Usage |
|---|---|---|---|---|
| GU10 | | 10 mm | | Twist-lock 120/230-volt MR16 halogen lighting of 35/50 watt, since mid-2000s |
| G12 | | 12.0 mm | 2.35 mm | Used in theatre and single-end metal halide lamps |
| G13 | | 12.7 mm | | T8 and T12 fluorescent tubes |
| G23 | | 23 mm | 2 mm | |
| GU24 | | 24 mm | | Twist-lock for self-ballasted compact fluorescents, since 2000s |
| G38 | | 38 mm | | Mostly used for high-wattage theatre lamps |
| GX53 | | 53 mm | | Twist-lock for puck-shaped under-cabinet compact fluorescents, since 2000s |

The list above is representative and should not be taken to include all the standards or form factors that may be utilized within embodiments described herein.

FIG. 7A through FIG. 7I depict embodiments of the present disclosure in the form of large form-factor lamp applications. In these lamp applications, one or more light emitting diodes are used in lamps and fixtures. Such lamps and fixtures include replacement and/or retro-fit directional lighting fixtures.

Figure 7A:
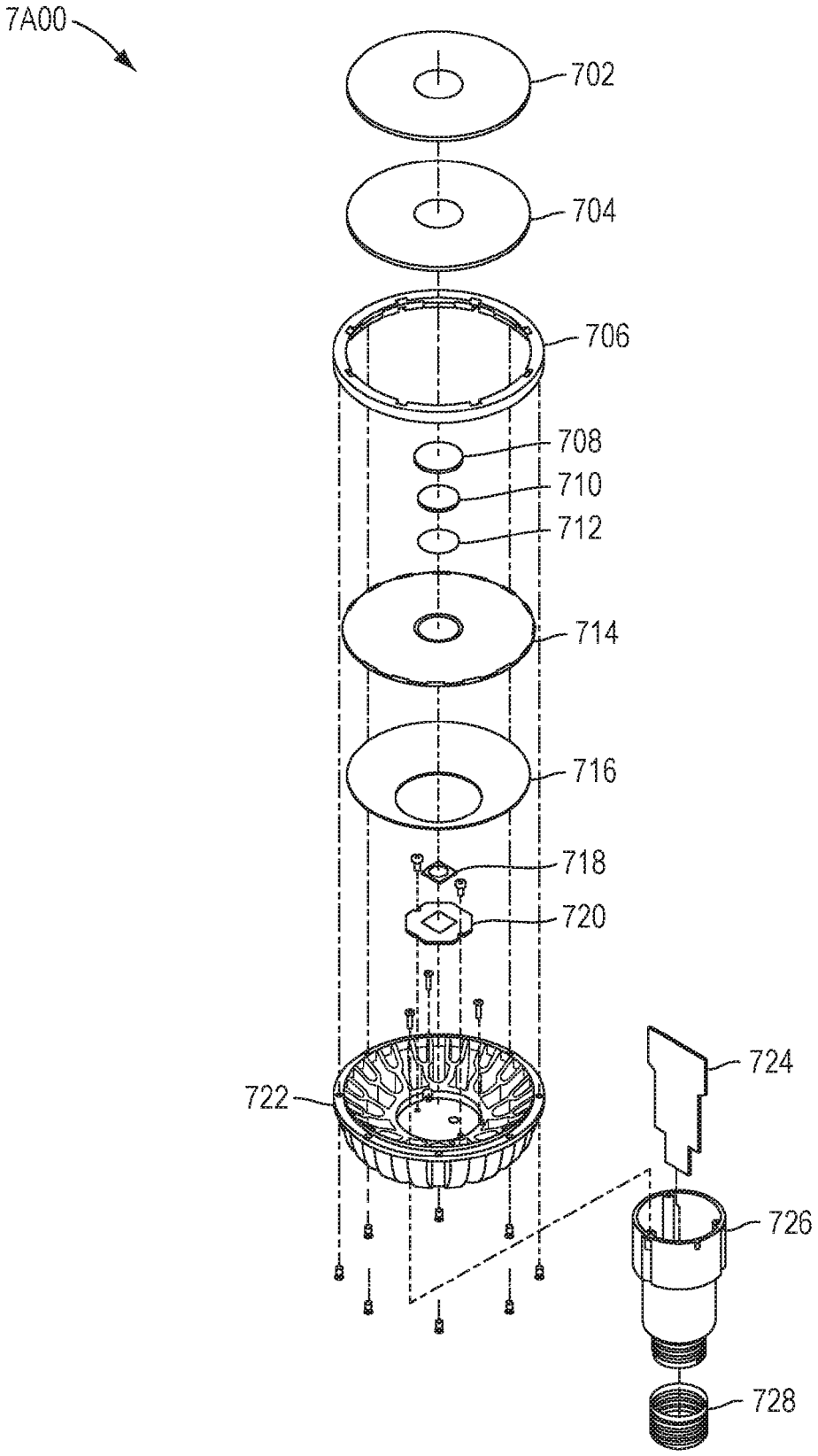
FIG. 7A through FIG. 7I depict embodiments of the present disclosure in the form of large form-factor lamp applications, according to some embodiments.

In some embodiments, aspects of the present disclosure can be used in an assembly. As shown in FIG. 7A, the assembly comprises:

a screw cap 728
a driver housing 726
a driver board 724
a heatsink 722
a metal-core printed circuit board 720
an LED lightsource 718
a dust shield 716
a lens 714
a reflector disc 712
a magnet 710
a magnet cap 708
a trim ring 706
a first accessory 704
a second accessory 702

The components of assembly 7A00 may be described in substantial detail. Some components are 'active components' and some are 'passive' components, and can be variously-described based on the particular component's impact to the overall design, and/or impact(s) to the objective optimization function. A component can be described using a CAD/CAM drawing or model, and the CAD/CAM model can be analyzed so as to extract figures of merit as may pertain to e particular component's impact to the overall design, and/or impact(s) to the objective optimization function. Strictly as one example, a CAD/CAM model of a trim ring is provided in a model corresponding to the drawing of FIG. 7A2.

Figures 1, 7B:
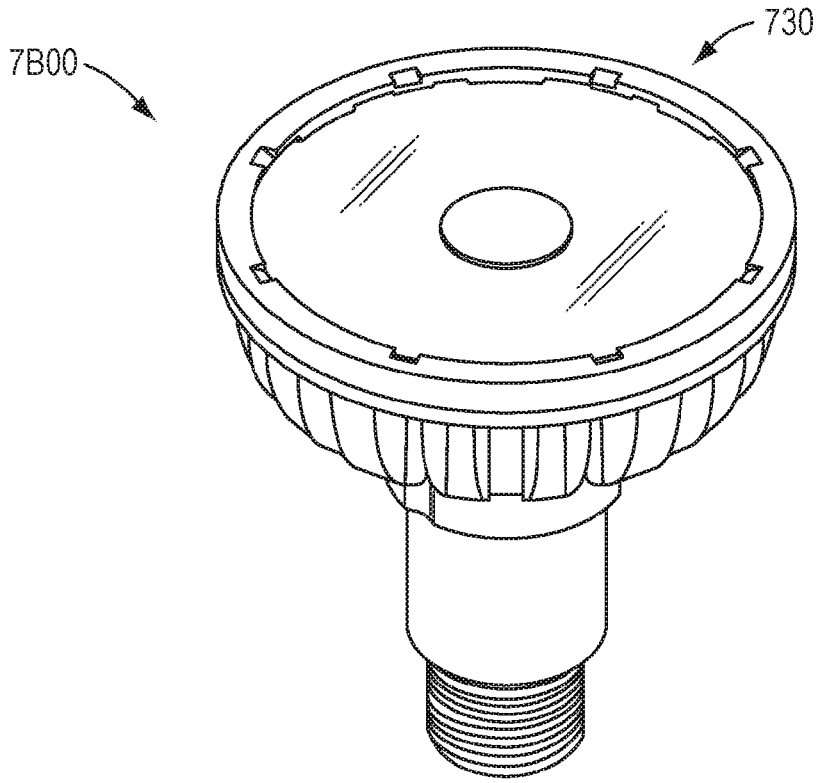
Figures 2, 7B:
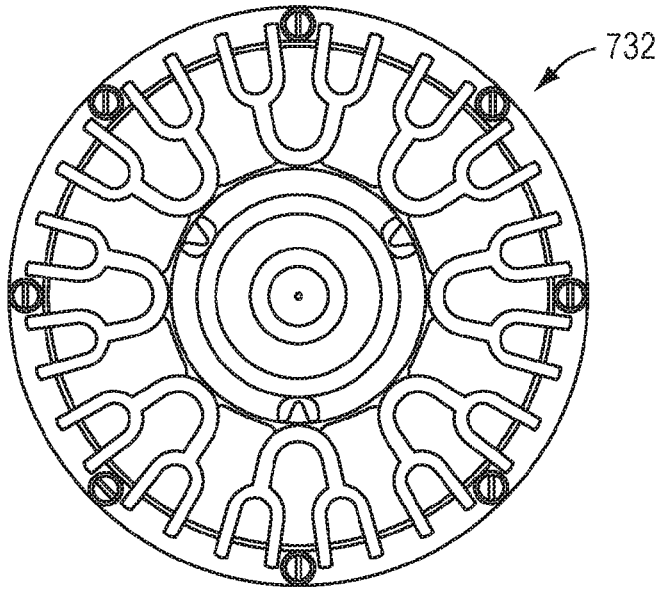
Figure 7C:
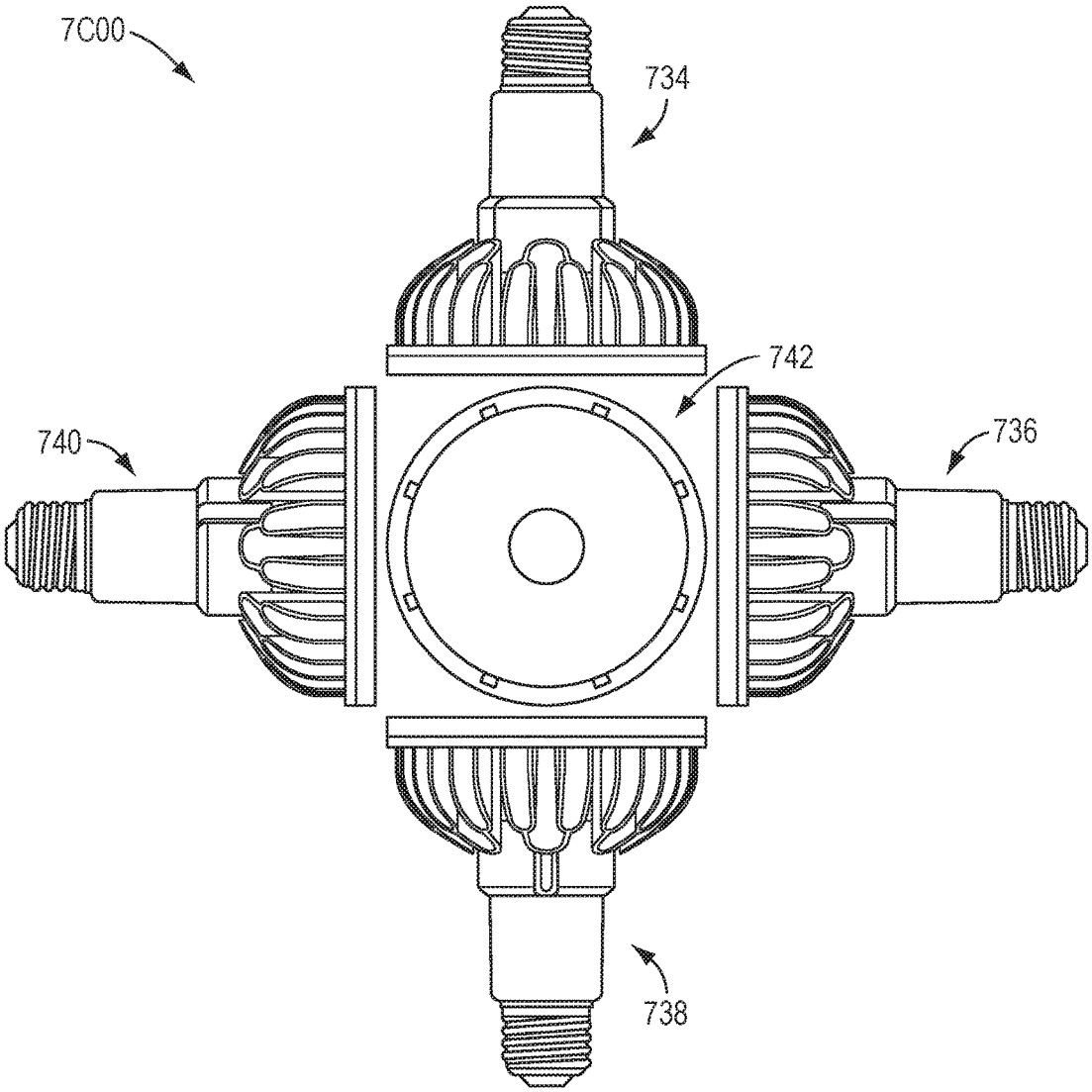

The components of the assembly 7A00 can be fitted together to form a lamp. FIG. 7B depicts a perspective view 730 and top view 732 of such a lamp. As shown in FIG. 7B, the lamp 7B00 comports to a form factor known as PAR30L. The PAR30L form factor is further depicted by the principal views (e.g., left 740, right 736, back 734, front 738 and top 742) given in array 7C00 of FIG. 7C.

Figures 1, 7D:
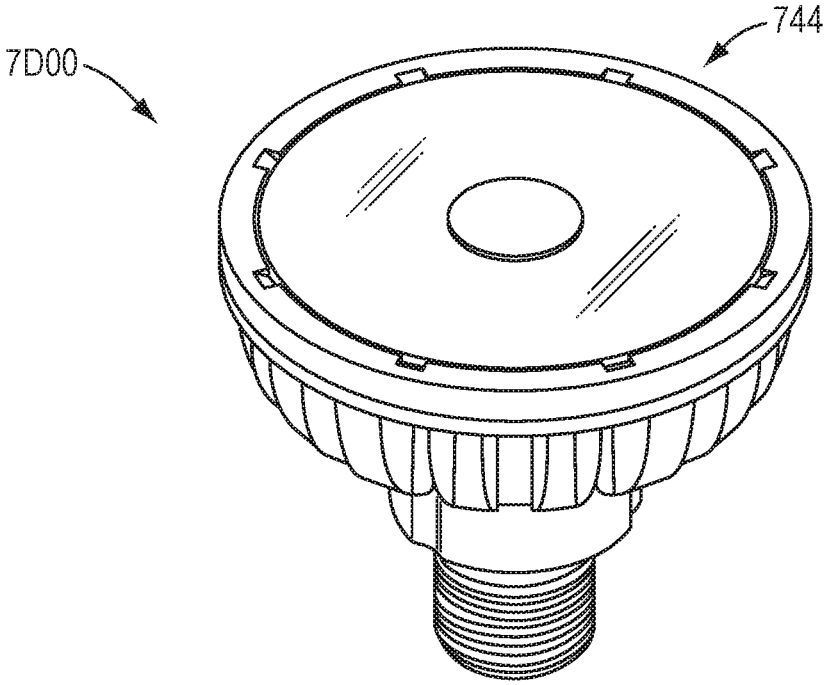
Figures 2, 7D:
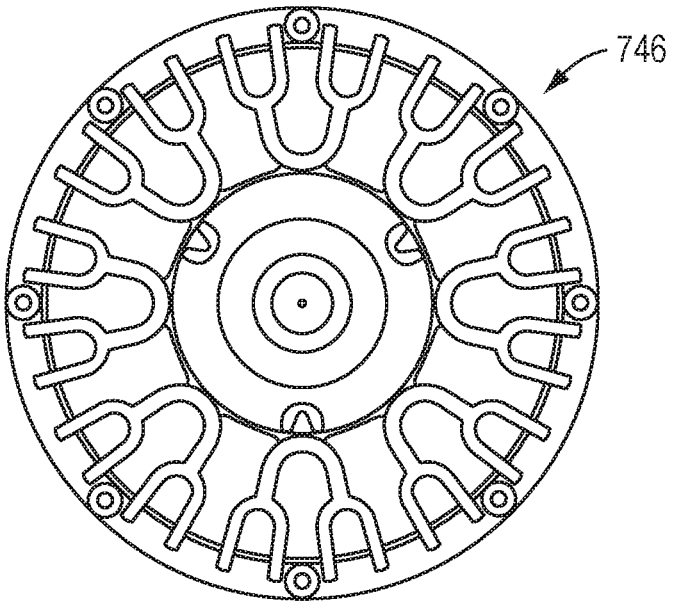
Figure 7E:
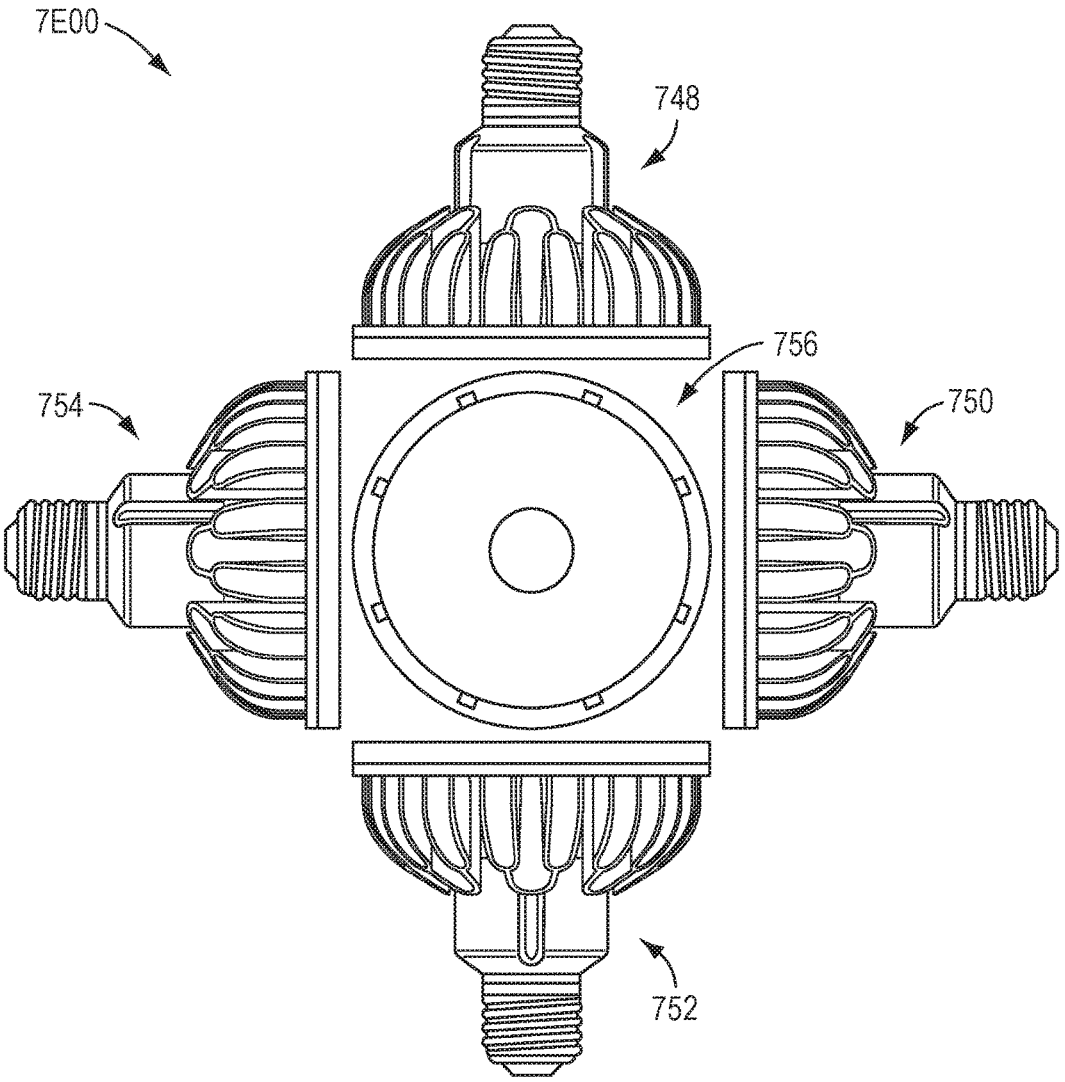

The components of the assembly 7A00 can be fitted together to form a lamp. FIG. 7D depicts a perspective view 744 and top view 746 of such a lamp. As shown in FIG. 7D, the lamp 7D00 comports to a form factor known as PAR30S. The PAR30S form factor is further depicted by the principal views (e.g., left 754, right 750, back 748, front 752 and top 756) given in array 7E00 of FIG. 7E.

Figures 1, 7F:
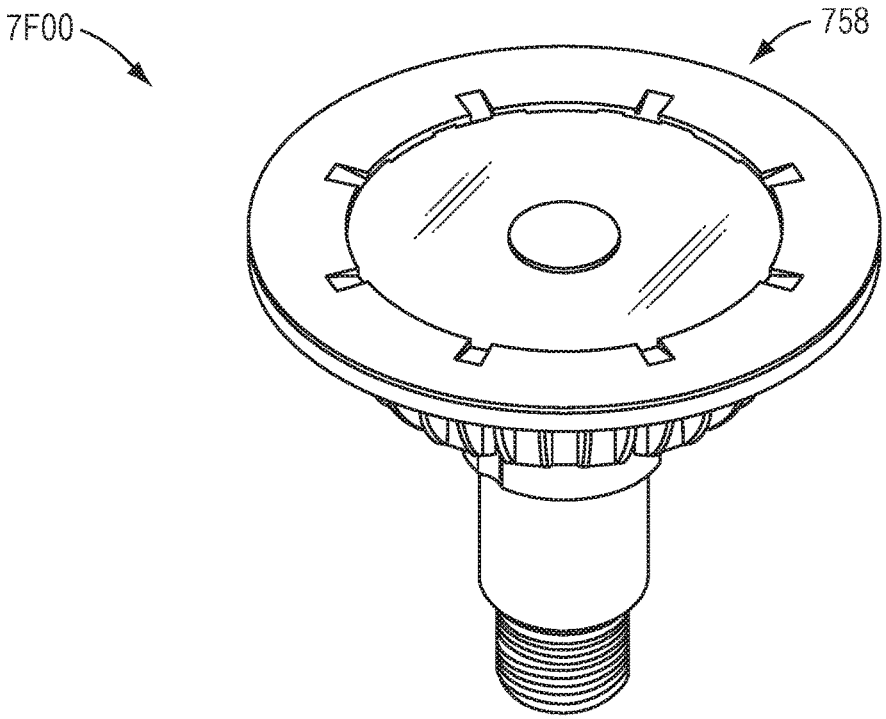
Figures 2, 7F:
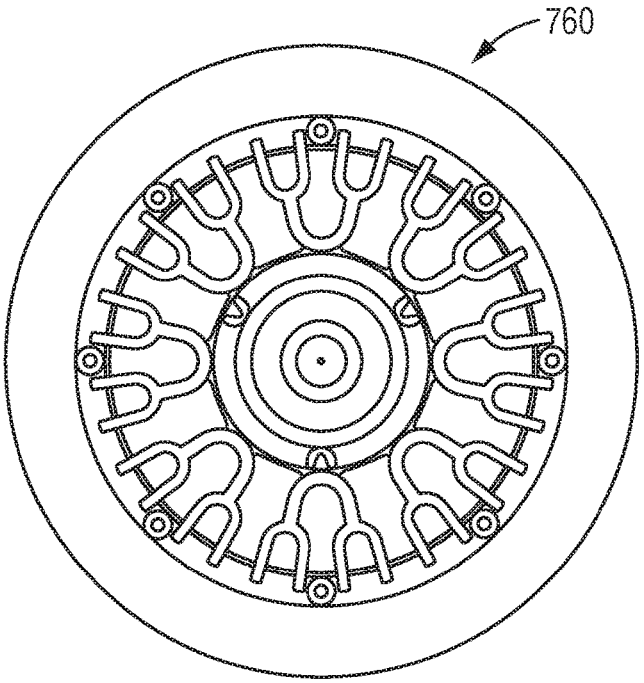
Figure 7G:
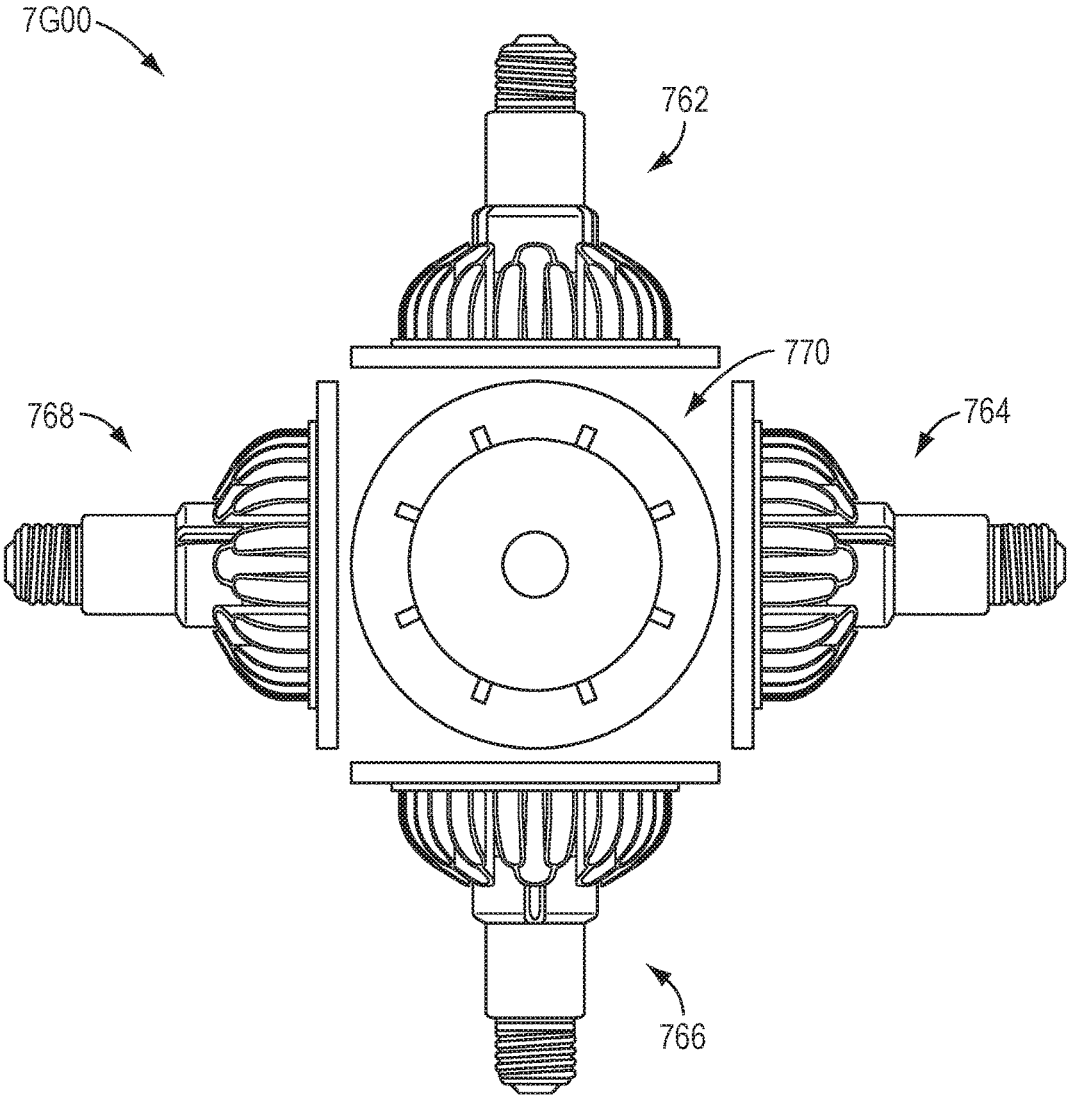

The components of the assembly 7A00 can be fitted together to form a lamp. FIG. 7F depicts a perspective view 758 and top view 760 of such a lamp. As shown in FIG. 7F, the lamp 7F00 comports to a form factor known as PAR38. The PAR38 form factor is further depicted by the principal views (e.g., left 768, right 764, back 762, front 766 and top 770) given in array 7G00 of FIG. 7G.

Figures 1, 7H:
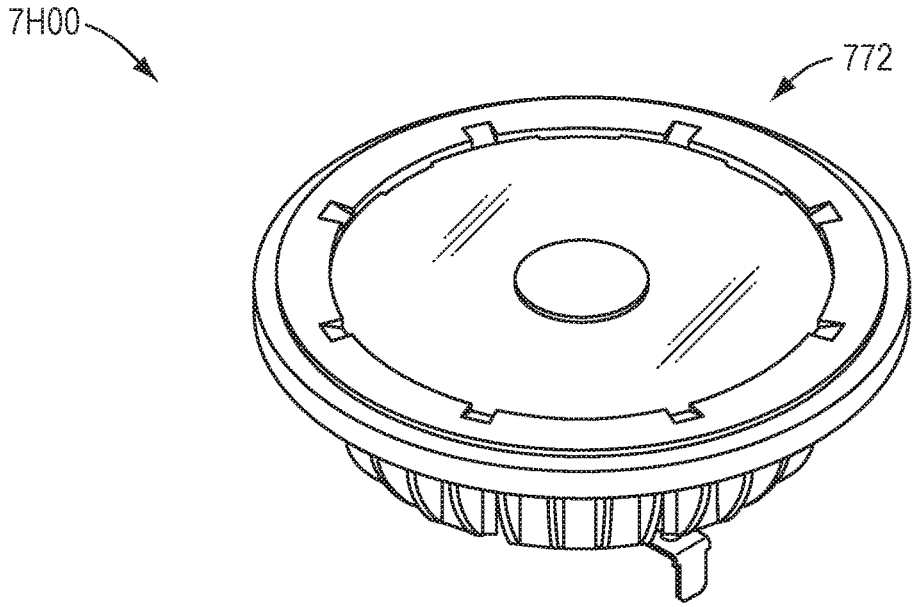
Figures 2, 7H:
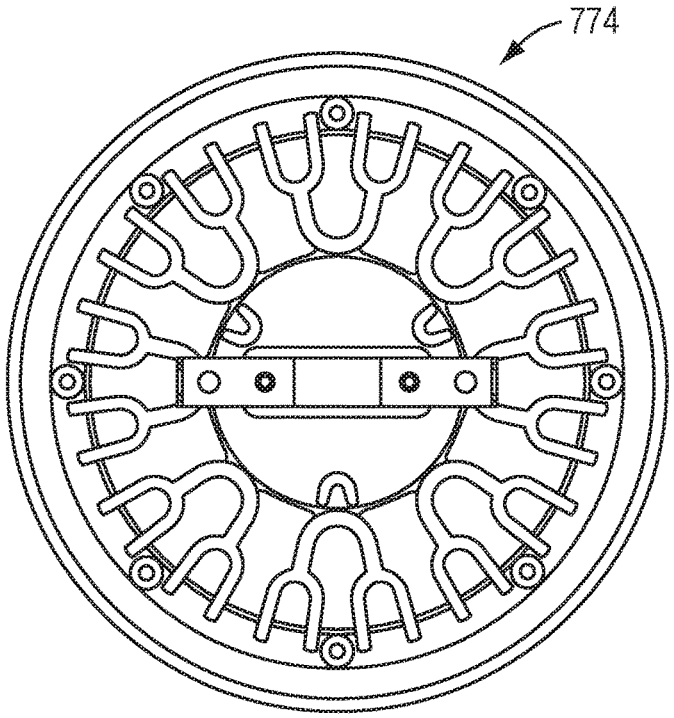
Figure 7I:
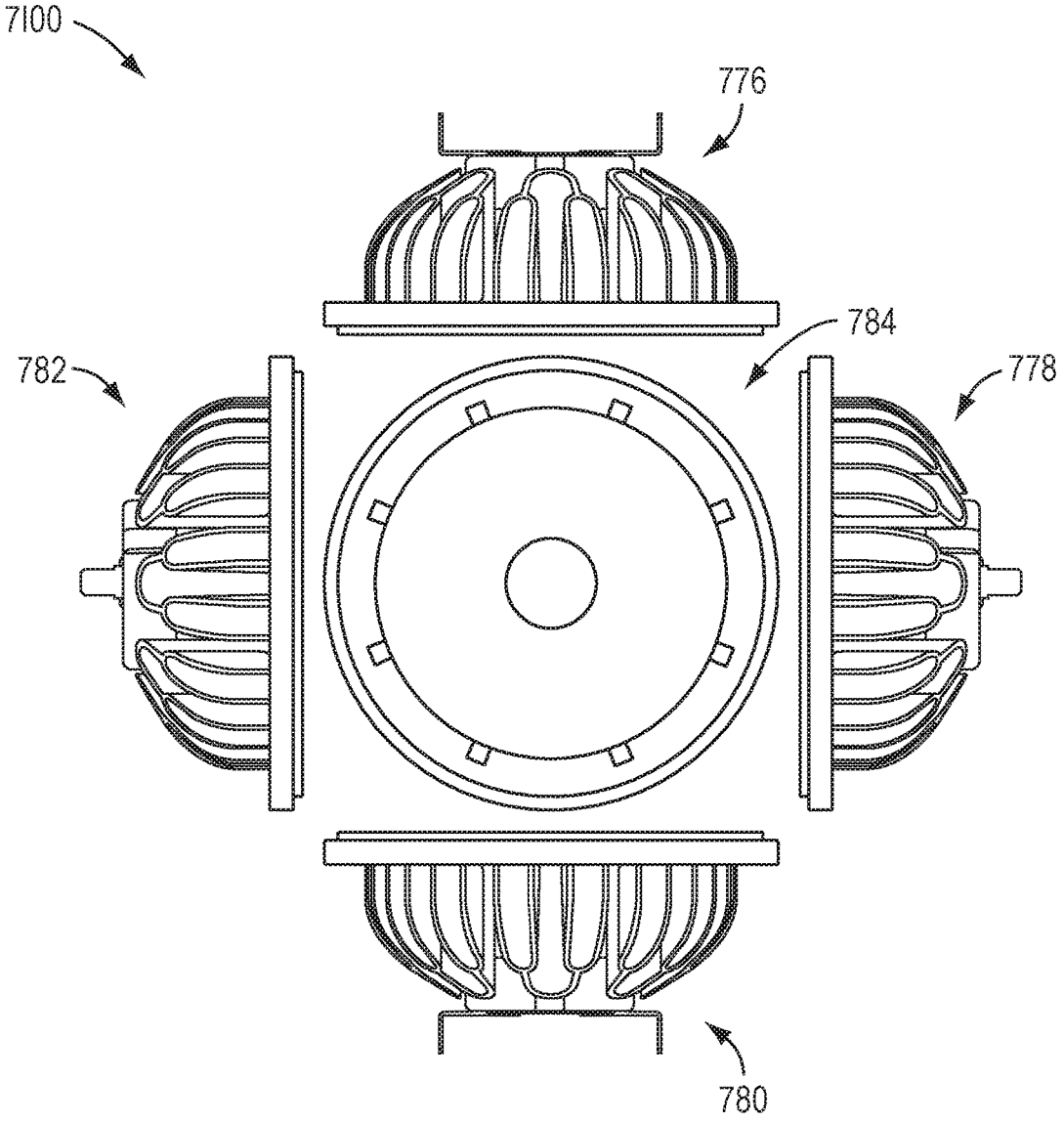

The components of the assembly 7A00 can be fitted together to form a lamp. FIG. 7H depicts a perspective view 772 and top view 774 of such a lamp. As shown in FIG. 7H, the lamp 7H00 comports to a form factor known as PAR111. The PAR111 form factor is further depicted by the principal views (e.g., left 782, right 778, back 776, front 780 and top 784) given in array 7100 of FIG. 7I.

The following claims describe in detail examples of constituent elements of the herein-disclosed embodiments. It will be apparent to those skilled in the art that many modifications, both to materials and methods, may be practiced without departing from the scope of the disclosure.

Finally, it should be noted that there are alternative ways of implementing the embodiments disclosed herein. Accordingly, the present embodiments are to be considered as illustrative and not restrictive, and the claims are not to be limited to the details given herein, but may be modified within the scope and equivalents thereof.

What is claimed is:

1. A light-emitting system for emitting light, comprising at least one light-emitting diode (LED) configured to emit LED light;

at least one optical element optically coupled to said at least one LED and configured to direct a first fraction of said LED light along a first optical path and a second fraction of said LED light along a second optical path; and a color modification element disposed along said second optical path and configured to modify the spectrum of said second fraction of said LED light to emit modified light, wherein said first fraction of said LED light comprises a first spectrum and said modified light comprises a second spectrum, and wherein said first spectrum differs from said second spectrum.

2. The system of claim 1, wherein said light comprises said first fraction of said LED light, and said modified light.

3. The system of claim 1, wherein said first optical path is along a primary projection plane, and wherein said second optical path does not intersect said primary projection plane.

4. The system of claim 1, wherein said at least one LED has an optical axis, and said optical axis is along said first optical path.

5. The system of claim 1, wherein said at least one LED is disposed on a plane, and said first optical path is normal to said plane.

6. The system of claim 1, wherein said optical element comprises at least one of a lens or a reflector.

7. The system of claim 1, wherein said color modification element is at least one of a dichroic stack or a colored medium.

8. The system of claim 1, wherein the system is a lamp.

9. The system of claim 1, further comprising at least one additional optical element.

10. The system of claim 1, wherein said color modification element comprises a fluorescing medium.

* * * * *